US007119483B2

(12) United States Patent
Westemeyer et al.

(10) Patent No.: US 7,119,483 B2
(45) Date of Patent: Oct. 10, 2006

(54) LAMP, IN PARTICULAR FOR AUTOMOTIVE HEADLIGHTS

(75) Inventors: Mandred Westemeyer, Aldenhoven (DE); Tilo Stoeckert, Plauen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 295 days.

(21) Appl. No.: 10/482,143

(22) PCT Filed: Jul. 5, 2002

(86) PCT No.: PCT/IB02/02642

§ 371 (c)(1),
(2), (4) Date: Dec. 22, 2003

(87) PCT Pub. No.: WO03/005399

PCT Pub. Date: Jan. 16, 2003

(65) Prior Publication Data

US 2004/0239226 A1 Dec. 2, 2004

(30) Foreign Application Priority Data

Jul. 6, 2001 (DE) ..... 101 32 923
Mar. 12, 2002 (DE) ..... 102 10 856

(51) Int. Cl.
*H01J 5/54* (2006.01)
*H01J 9/30* (2006.01)
*H01J 9/34* (2006.01)

(52) U.S. Cl. ..... 313/318.01; 313/318.08; 313/318.12

(58) Field of Classification Search ..... 313/318.01, 313/318.05, 318.06, 318.08, 318.12; 439/614, 439/605, 606
See application file for complete search history.

(56) References Cited

U.S. PATENT DOCUMENTS

| | | | | |
|---|---|---|---|---|
| 5,041,955 | A * | 8/1991 | Devir et al. | 362/306 |
| 5,291,092 | A | 3/1994 | Coushaine | 313/318 |
| 5,428,261 | A | 6/1995 | Wittig et al. | 313/318.1 |
| 5,463,270 | A | 10/1995 | Wakimizu et al. | 313/318.01 |
| 6,254,252 | B1 * | 7/2001 | Coushaine et al. | 362/549 |
| 6,270,235 | B1 * | 8/2001 | Coushaine | 362/645 |

* cited by examiner

*Primary Examiner*—Ashok Patel

(57) ABSTRACT

A lamp includes a burner configured to generate light and a base having a first part connectable to a second part. The first part is configured to hold the burner in a fixed position, and the second part is configured to allow electrical connection to the burner. The first and second base parts are made of different plastic materials, where the material of the first base part has a higher temperature stability and/or resistance to UV radiation then the material of the second base part. The first and second base parts are connected together by welding and/or bonding using an adhesive.

11 Claims, 7 Drawing Sheets

LAMP, IN PARTICULAR FOR AUTOMOTIVE HEADLIGHTS

The invention relates to a lamp, in particular a lamp for an automotive headlight, as well as a series of such lamps and a method of manufacturing same.

In the field of automotive lighting, a plurality of different electrical lamps are known. These lamps comprise a burner for generating light, which burner is held in position in a base. As regards the burners, a distinction can be made between, in particular, incandescent lamps and discharge lamps. As regards the bases, a large number of standardized types are available that fit in appropriate seats of a reflector.

For use in a headlight, it is very important that the light-generating element, for example a spiral-wound filament or a light arc, is accurately positioned within the reflector. To enable the light-generating element to be accurately positioned, known reflectors comprise seats with reference planes. The bases of the lamps fitting these seats are provided with reference elements which, in the assembled state, engage the reference planes, so that the base is in a defined position at the reflector.

In the manufacture of lamps care should be taken that the position of the burner is accurately aligned with respect to the reference element of the base. To achieve this, the lamps are aligned, in the manufacturing process, after the burner and the base have been assembled.

The rear part of the base of known lamps comprises a connection device for electrical contacts. Different, standardized connection mechanisms, particularly plug and socket connections, are known. For example, in the case of (halogen) incandescent lamps, on the one hand, bent plug embodiments are known wherein contacts for the connection of a plug are provided at right angles to the longitudinal axis of the lamp. On the other hand, also connection mechanisms are known wherein contacts for connecting a plug are arranged parallel to the longitudinal axis of the lamp.

In U.S. Pat. No. 5,428,261 a description is given of a base for a discharge lamp. Said base is composed of a first part of plastics, wherein the burner is held in position, and a second part of plastics that comprises the electrical contacts. The first part, which is covered with a ceramic disc, forms a flange that serves as the standardized securing ring for discharge lamps, which securing ring forms the reference plane enabling accurate positioning in the reflector. The first part and the second part are interconnected by means of a snap-in connection. A collar, to which brackets are welded, is used to hold the burner in position. Said brackets extend up to the first part and are connected to said first part by means of high-frequency welding. In said patent it is indicated that identical first parts are combined with different second parts to form different electrical connections.

The base of the lamp in accordance with the invention comprises at least two parts, i.e. a first base part and a second base part. The second base part comprises the connection mechanism for the electrical contacts. The first base part holds the burner and comprises at least one reference element for positioning the lamp at a headlight. In the lamp in accordance with the invention, the first part is referred to as the "upper part" and the second part is referred to as the "lower part". These designations relate to the vertical position of a lamp, in which the burner is arranged at the top and the base is arranged at the bottom. These designations are used for clarity and are not to be interpreted in a limiting sense.

In accordance with the invention, the base parts are at least partly made from plastics. For example, the upper part may be composed of plastic part into which metal parts are cast so as to preferably orientably fix the burner. The lower part is preferably composed of a one or multi-piece plastic part having electrical contacts. Both base parts are separate units that can be individually manufactured and that are subsequently interconnected. On the one hand, a welded joint formed in plastics welding operation is proposed to interconnect said parts. Welding results in a rigid connection having sufficient mechanical stability and enabling the burner to be secured in an accurate position. It is particularly preferred to employ plastics welding process wherein no welding aids, in particular RF rings, as receivers of welding energy are provided between the upper part and the lower part. Examples of such welding processes are heated tool welding, if necessary hot air-supported, ultrasound welding or friction welding.

On the other hand, the lower part and the upper part can alternatively be bonded together using an adhesive. Suitable adhesives for plastic materials are known, so that the adhesive bond is sufficiently strong.

The upper part and the lower part may be manufactured from the same plastic material. Alternatively, different plastic materials may be used. It is very advantageous, particularly in the case of discharge lamps, to use a combination of plastics that is resistant to high temperatures (i.e. resistant to temperatures above 220° C., preferably even above 250° C.) for the upper part, which is situated closer to the heat source of the burner, and a less temperature-stable (and hence cheaper) plastic for the lower part.

To hold the burner in position, the upper part comprises holding means, which are preferably made of metal. Preferably these holding means comprise, on the one hand, a clamping element (for example a collar, a clamping sleeve, a clamping plate or a clamping cam) that directly engages the glass bulb (for example at the lower shaft or at a location of taper referred to as "pinch") of the burner and, on the other hand, at least one connection element (for example metal brackets or a sleeve) which is rigidly connected to the upper part of the base, for example formed therein by means of injection molding.

In accordance with a modification of the invention, the holding means are embodied such that, in the manufacturing process, the burner is initially held in position so as to be orientable, after which it can be fixed in an oriented position. Such fixable holding devices are known per se. For example, an inner metal sleeve attached to the burner is telescopically accommodated in an outer metal sleeve formed in the base by means of injection molding, so that during orienting the burner, said burner can be tilted as well as moved along its longitudinal axis. In the case of a discharge lamp, holding brackets projecting from the base part may initially be in clamping contact with a collar attached to the burner. In the manufacturing process, the burner is subsequently oriented such that the light-generating element, i.e. the spiral-wound filament or the discharge arc, is arranged in an exact, predetermined position with respect to the reference elements. The burner is fixed in this oriented position, for example by means of laser welding or resistance welding.

The reference elements provided in the first base part serve to exactly position the lamp in a headlight. Reference elements that bear against a headlight and define the axial position of the lamp are known per se, for example three radially projecting metal brackets in the known "H4" lamp, or the standardized securing ring for discharge lamps. It is also possible that reference elements are provided to exactly determine the radial position of the lamp, for example a cylindrical area of the lamp that is accurately accommodated in an appropriate holder of a reflector.

The lower base part comprises connection means for electrical contacts. Many different types of connection means are known. In the case of incandescent lamps, plug connections are used comprising, for example, two or three projecting metal contacts around which an insulating plug housing is provided. In accordance with the state of the art, "straight" plug contacts are known, in which a plug is slipped on in a direction parallel to the longitudinal axis of the lamp, as well as so-termed "curved" plug contacts for connecting a plug in a direction perpendicular to the longitudinal axis of the lamp. In the case of discharge lamps, the connection devices are generally differently designed because the higher voltage level requires better insulation. Also in the case of discharge lamps, many different types of connection devices are known.

In the manufacturing process in accordance with the invention, the first and the second base part are separately manufactured. The burner is introduced into the first base part. The upper part and the lower part are not united until after the burner has been introduced and secured in the upper part.

In this manner, a series of lamps are manufactured wherein the upper parts are identical and the burners are identical, whereas the lower parts used are different. By virtue thereof, it is possible to manufacture (after welding together the parts) one-piece bases in accordance with the building block system. The total manufacturing cost can be reduced in that, for example, the upper part is embodied so as to be a very simple standard part that is used as an identical element in each type of a set of different lamps.

The always identical upper part is preferably formed so as to be very simple. In the case of discharge lamps, said upper part may be, for example, ring-shaped. In this case, the term "ring-shaped" is not to be taken to mean that said upper part must be a fully rotationally symmetrical body; instead said ring may be interrupted or exhibit snap-in projections. A part that is formed so as to be very simple, in particular a ring-shaped part, can be manufactured in a very simple and economical manner using, for example, a multiple cavity mold.

The lower parts of the different bases of the series of lamps differ from each other, for example, in that the electrical contacts are differently formed and arranged. By connecting together the always identical upper part and, dependent upon the application, different lower parts, a plurality of different lamps can be economically manufactured.

In accordance with a further modification of the invention, it is very advantageous if the burner is oriented after its introduction into the first base part and secured in said oriented position. By virtue thereof, the units composed of upper part and burner can be completely manufactured before they are connected with the lower part of the base.

In accordance with a further aspect of the invention, the lower part is composed of at least two portions, which are referred to as "center portion" and "end portion". Also in this case these designations are chosen for clarity and should not be interpreted in a limiting sense. The division of the lower part is not necessarily a transverse division; alternatively, a division in a direction along the central axis is also possible.

This aspect can be readily combined with the above-described properties, but it can also be advantageously used by itself. Advantages are obtained, in particular, if the subdivision enables an electrical contact element, generally of metal, to be positioned and fixed more readily. Such an electrical contact can be provided between the center portion and the end portion, and fixed between them by joining together said portions. For example, a ring-shaped contact can be inserted into the center portion or slid onto the end portion, said contact being matchingly accommodated after the portions have been joined together.

These and other aspects of the invention are apparent from and will be elucidated with reference to the embodiments and drawings described hereinafter.

Figure 1:
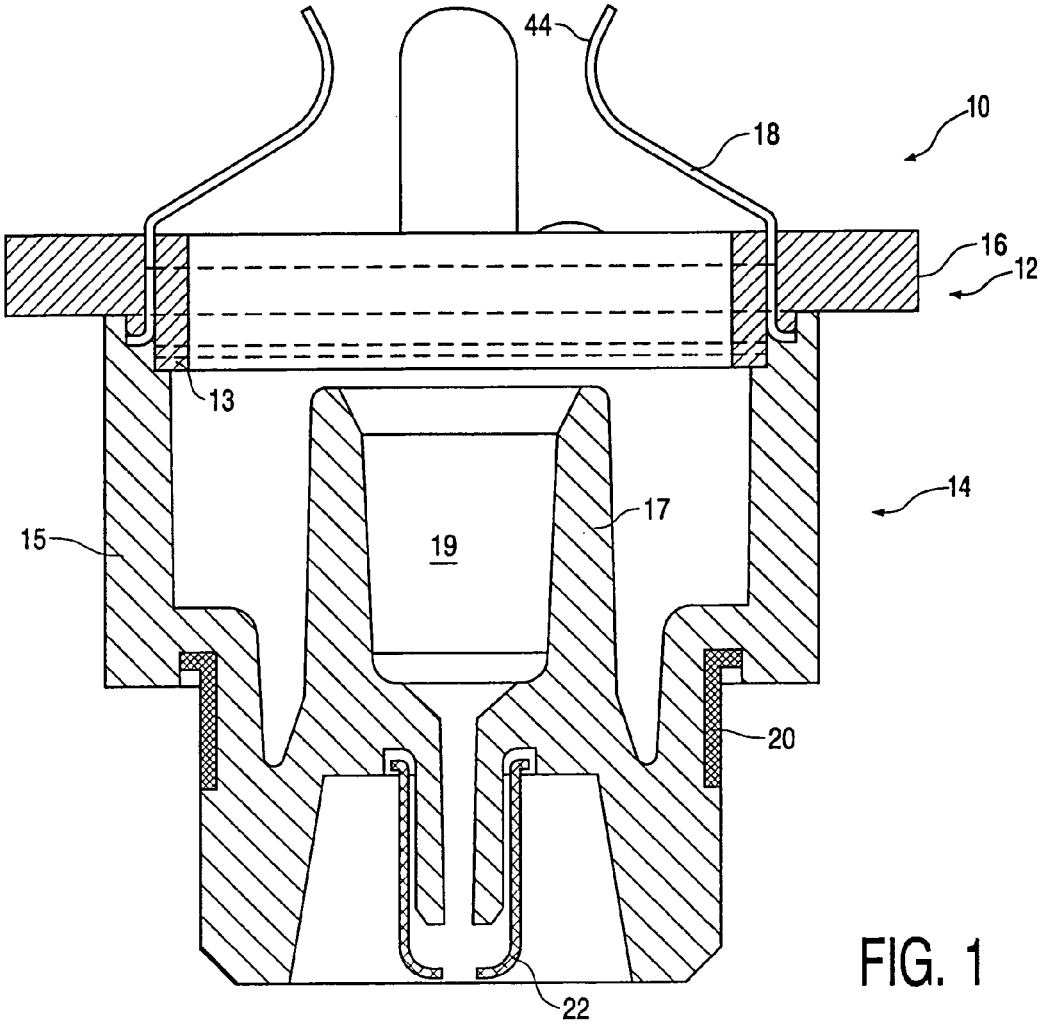
FIG. 1 is a longitudinal sectional view through the base of a first embodiment of a lamp in accordance with the invention.

FIG. 1 shows a base 10 for a discharge lamp. Said base 10 is composed of a ring-shaped upper part 12 and a lower part 14. The upper part 12 comprises a circumferential securing ring 16 and, on the inside thereof, a multistage ring 13. The end portions of four brackets 18, the tips of which are bent, are cast into the upper part 12. The brackets 18 project upward from the upper part 12 and are bent towards the center. They are used to secure a burner, as will be described in greater detail hereinbelow.

Like the upper part 12, the lower part 14 is made of plastic that is mechanically and electrically stable to temperatures in excess of 220° C. In this example, the plastic is a PPS material with fillers, in this case glass fibers. In operation, a burner accommodated in the base 10 causes a heavy load, in the form of heat as well as UV radiation, to be put on the upper part 12 of the base 10. For this reason, the above-mentioned thermally highly stable plastic is preferably used for this part. To reduce costs or in view of other, for example, mechanical requirements, the lower base part 14 may alternatively be manufactured from a different plastics material. The material used for the lower base part does not have to meet the same requirements regarding temperature stability and resistance to UV radiation. As a result, use can generally be made of a cheaper material. Regard should be had, however, to the fact that the two different plastic materials can be welded together or bonded together using an adhesive.

The lower part 14 is shaped so as to be essentially rotationally symmetrical. Outer walls 15 form a cup-shaped housing wherein an inner sleeve 17 surrounds an inner area 19 that is open at the top. Metal contacts 20, 22 are provided in the lower part 14. A ring contact 20 is matchingly accommodated in the plastic part 14 that is in one piece. This is achieved in that the plastic part 14 is formed around the ring 20 by means of injection molding. The other contact, i.e. central contact 22, consists of a centrally arranged metal sleeve that projects downward. The inner contact 22 is separated from the ring contact 20 by the outer walls 15 of the lower part 14. As high voltages occur, this is particularly advantageous in terms of insulation.

In the example shown, upper part 12 and lower part 14 of the base 10 are interconnected by means of a suitable plastics welding process. In this case, a welding process is selected in which an additional element to be provided between the parts, such as an RF ring that is necessary for high-frequency welding, is not necessary to couple in the welding energy.

Suitable welding processes are ultrasound welding processes which are known per se. In these processes, the parts 12, 14 to be welded are joined and 20–40 kHz oscillations in the ultrasound range are coupled in. The resultant friction between the parts causes the material to melt at the places of contact and subsequently unite. As is known from the literature on this subject, this can additionally be enhanced if the parts to be united comprise so-termed "energy directing portions", i.e. projecting wedges or ridges that melt first and thus cause the parts to be interconnected.

The parts 12, 14 can also very suitably be interconnected by means of friction welding. In this method, which is also known per se, the surfaces to be joined by welding are rubbed against each other, thereby generating heat causing the parts to be joined by melting. The round shape of the upper part 12 and the lower part 14 as well as the essentially rotationally symmetrical shape of the connection areas (stepped ring 13 with its counterpart) readily enables the parts that are accommodated in suitable holders to be pressed together and rotated in opposite directions. In experiments wherein heat-resistant plastics were used, very good results were achieved at a rotational speed of 600 revolutions per minute, with 6 revolutions per minute already being sufficient to form a good bond. Also in the case of friction welding, the result is improved if the parts to be welded together are shaped such that they are interengageable by imparting a rotating movement, for example a ring-shaped groove provided in one part and a mating ridge provided on the other part.

The parts 12, 14 can also be interconnected by means of heated tool welding, with or without the supply of hot air. In this method, the parts to be interconnected are arranged opposite each other and a so-termed "heating mirror" which is heated to approximately 500° C. and, if necessary, equipped with hot air outlets, is arranged between them. The heat radiation and the possible flow of hot air causes specially formed lips on the surface of the plastic parts to melt. After removal of the heating mirror, the parts 12, 14 are joined and welded together. Alternatively, devices may be provided that take in air which is used to heat the surfaces of the parts to be welded together.

Figure 2:
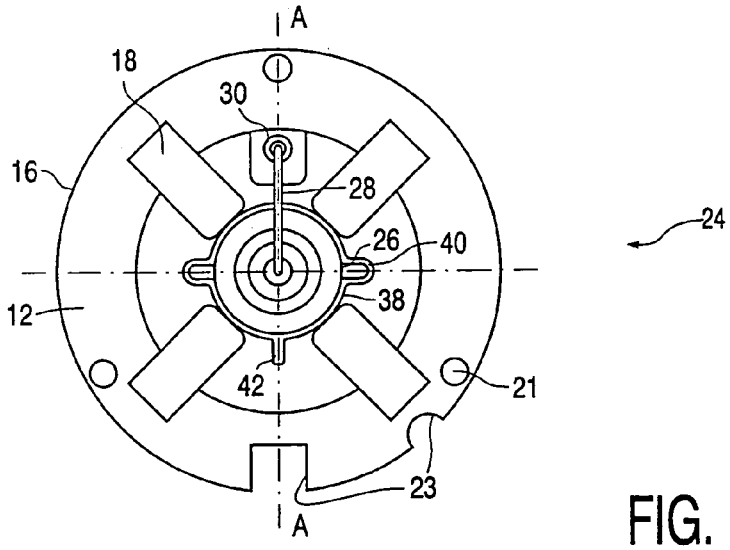
FIG. 2 is a plan view of the discharge lamp in accordance with the first embodiment.
Figure 3:
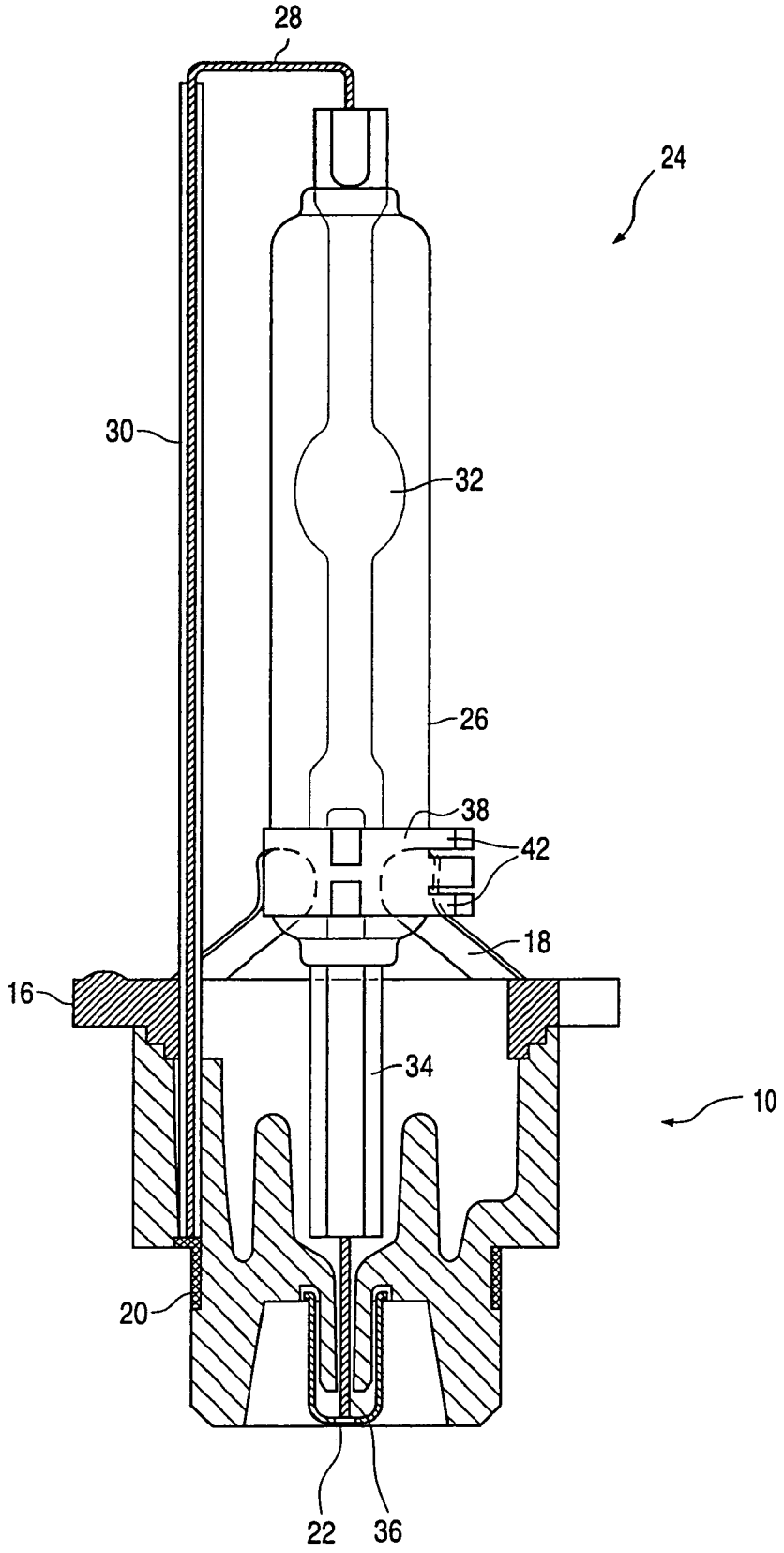
FIG. 3 is a side view, partly in section, of the discharge lamp shown in FIG. 2.

FIGS. 2 and 3 show a discharge lamp 24. This discharge lamp is composed of the base 10, shown in FIG. 1, a burner 26 accommodated therein and a back contact 28 around which an insulating tube 30 is arranged.

FIG. 2 is a plan view showing the shape of the ring-shaped upper part 12 of the base 10. Said upper part 12 is ring-shaped with a round recess in the middle. The outwardly projecting securing ring 16 is provided with projecting parts (cams) 21 and recesses (grooves) 23. This shape of the securing ring 16 is internationally standardized and serves as a reference element, enabling exact positioning in known automotive headlamps.

In the example shown in FIG. 3, the burner 26 is of the two-sided type. Said burner comprises an elongated glass bulb at the ends of which electrical contacts are provided. Said glass bulb accommodates a discharge vessel 32 in which the actual gas discharge takes place. At the lower side, the burner 26 ends in a tube 34 accommodating a conductor 36 for the electrical connection, which conductor is connected to the contact 22. At the other end of the burner 26 there is the back contact 28 which is led back into the base 10, where it is connected to the ring contact 20, through the tube 30. Back contact 28 and conductor 36 are welded to the ring contact 20 and the central contact 22, respectively.

A collar 38 is arranged around the lower part of the burner 26. This collar is made of steel and is provided with two stress-relief brackets 40. By means of two welding spots 42, the collar 38 is closed at one location in such a manner that the collar is a tight fit on the glass bulb, and thereby secures the glass bulb.

The burner 26 is held in position within the base 10 by the connection between the brackets 18 and the collar 38. The four brackets 18 have curved ends 44 which lie flat against the outside of the collar 38. At said points of support, they are connected to the collar 38 by means of welding joints. These welding joints are produced by a laser welding process in the example shown. In this process, the burner 26 is introduced into the base 10 in such a manner that the exhaust tube 34 is accommodated in the area 19. The position of the burner 26 with respect to the base 10 is then accurately oriented. Said orientation takes place in such a manner that the discharge vessel 32 is in a defined position with respect to the reference element (securing ring 16). In this oriented position, the brackets 18 extending as far as the collars 38 are welded on by means of laser welding.

Figure 4:
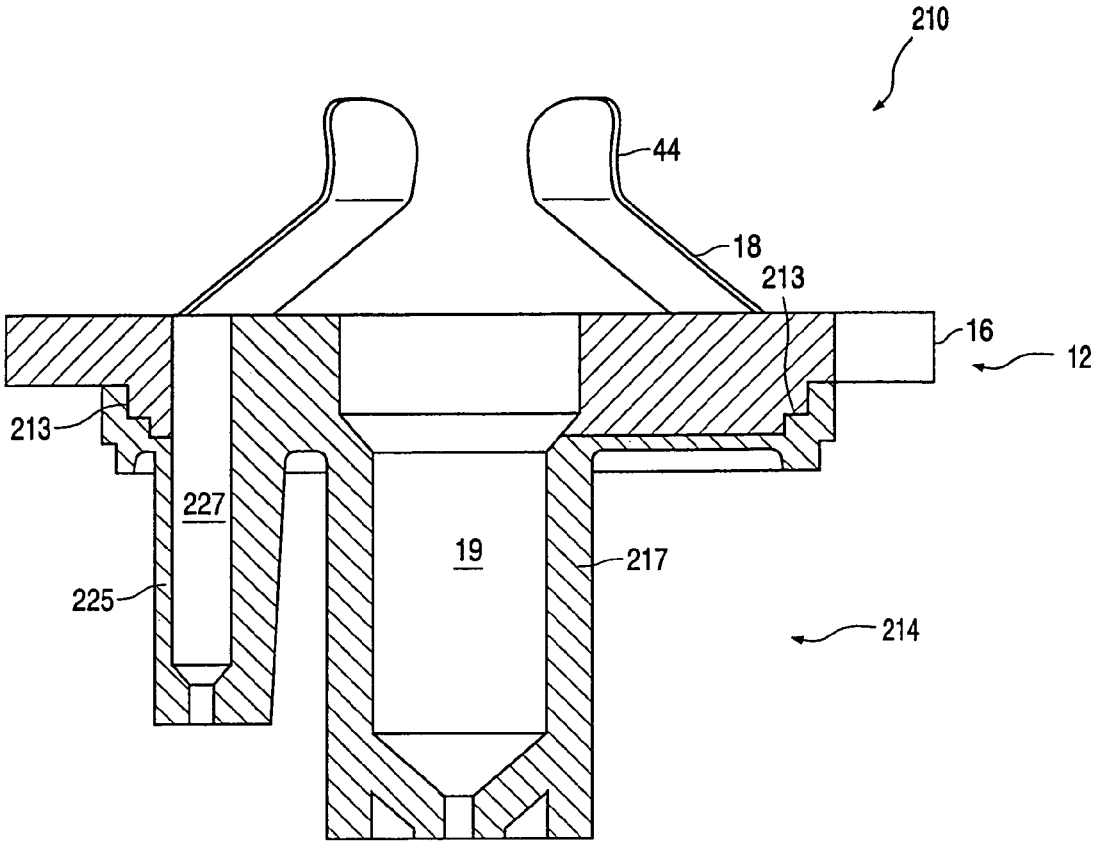
FIG. 4 is a longitudinal sectional view through a base of a second embodiment of a lamp in accordance with the invention.

FIG. 4 shows the base of a second embodiment of a lamp, said base being composed of a ring-shaped upper part 12 and a lower part 214. The upper part shown in FIG. 4 is identical to that shown in FIG. 1. In this Figure, however, the upper part 12 is connected with a different lower part 214 by means of any one of the above-mentioned welding processes. In FIG. 4, parts that are identical to parts shown in FIG. 1 bear the same reference numerals. The lower part 214 is shaped such that it engages with the central hole of the upper part 12. In addition, the lower part 214 comprises a circumferential groove 213 accommodating the multi-stage flange 13 of the upper part 12. Such an interengaging embodiment enables a mechanically very firm connection to be achieved.

The lower part 214 of the second embodiment does not comprise outer walls 15, but only a housing 217 that surrounds the area 19 and corresponds to the inner sleeve 17 of the first embodiment. Unlike the first embodiment, contact is made via two parallel-arranged contacts. This base 210 is intended to be used in an ignition unit. A space 227 for accommodating the return pole including the insulation tube is bounded by a casing 225.

The different shapes of the bases 10, 210 shown in FIGS. 1 through 4 only serve as examples of possible base shapes. In practice, very differently embodied bases are required depending, for example, on the mode of contacting used. These bases, however, always comprise the standardized securing ring 16 for positioning in the holder of a headlamp.

For this reason, the two-stage base 10 composed of lower and upper parts 12, 14 or 214 is used in the building block system. The always identical upper part 12 is economically manufactured in large numbers and, dependent upon the type of base required, connected with a special lower part 14, 214, or with a different one. By welding together the parts, a single-piece base that is adapted to the requirements is always obtained.

Of the different types of lower parts 14, 214 of the bases 10, 210, only two examples are shown in this description. However, the types of bases necessary for different applications are known to persons skilled in the art.

Figure 5:
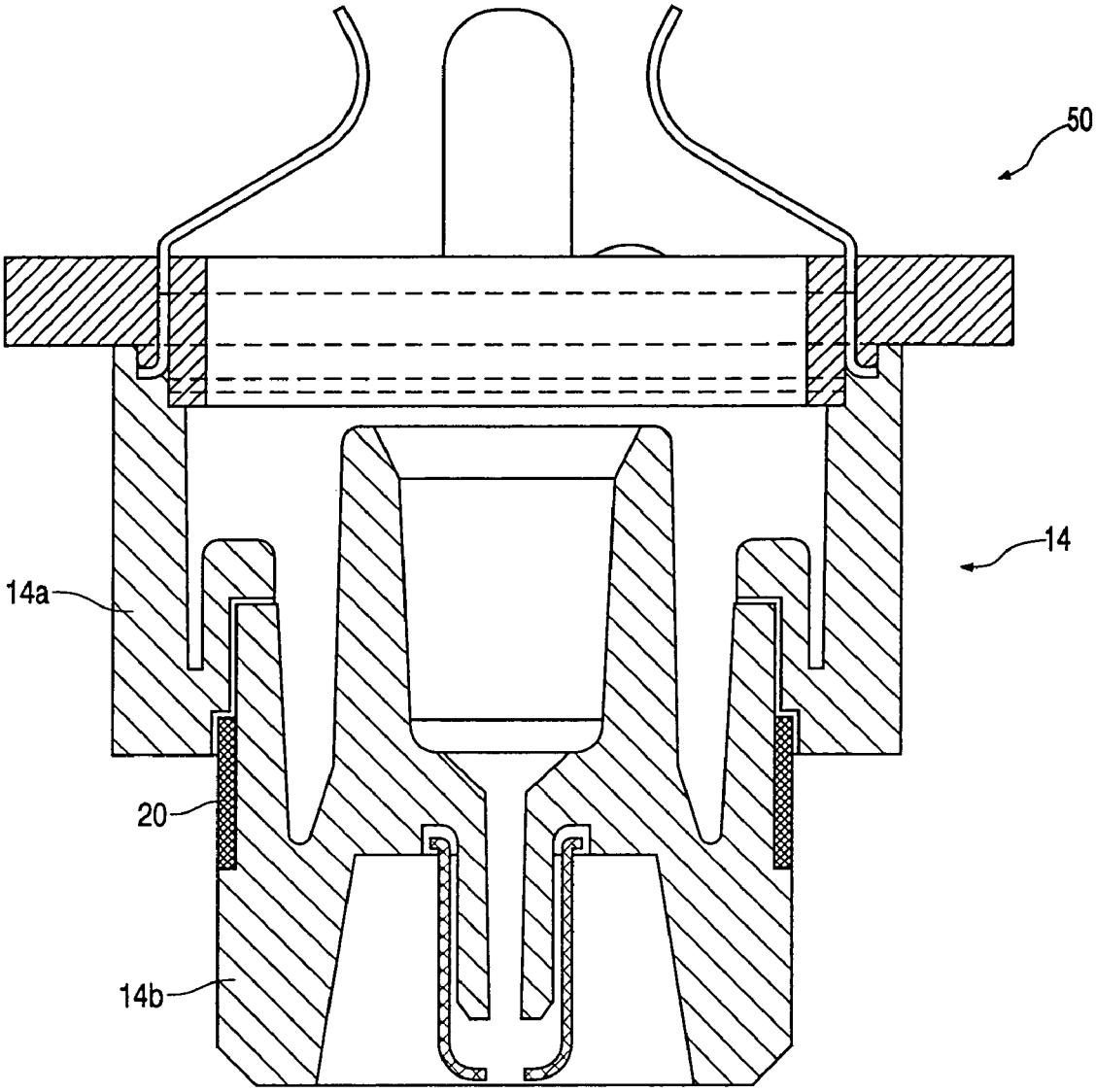
FIG. 5 is a longitudinal sectional view through the base of a third embodiment of a lamp in accordance with the invention.

FIG. 5 shows a base 50 of a third embodiment of a lamp. Said base 50 largely corresponds to the base 10 of FIG. 1, so that a complete description is not given again. Unlike the base 10 of FIG. 1, the base 50 comprises a lower part 14 made of two separate plastic portions, i.e. a central portion 14*a* and an end portion 14*b*. Both portions 14*a*, 14*b* of the lower part 14 are fixedly interconnected so as to form one part. For this purpose, any one of the above-mentioned welding processes for plastics can be employed, or the portions can be bonded together using an adhesive.

The ring contact 20 is fixed between the portions 14*a*, 14*b*. After joining the portions 14*a*, 14*b*, said ring contact is matchingly housed in the part 14 thus formed of the base 50. In the manufacture of the lower part 14, the ring contact is stuck on the end portion 14*b* which is then inserted into the central portion 14*a*, so that the ring contact 20 is fixed between the two portions 14*a*, 14*b*. Subsequently, the central portion 14*a* and the end portion 14*b* are welded together or bonded using an adhesive.

The lamps in accordance with a fourth and a fifth embodiment that will be described hereinafter are incandescent lamps for automotive applications. The burner is composed of a glass tube wherein spiral-wound filaments are arranged.

Figure 6:
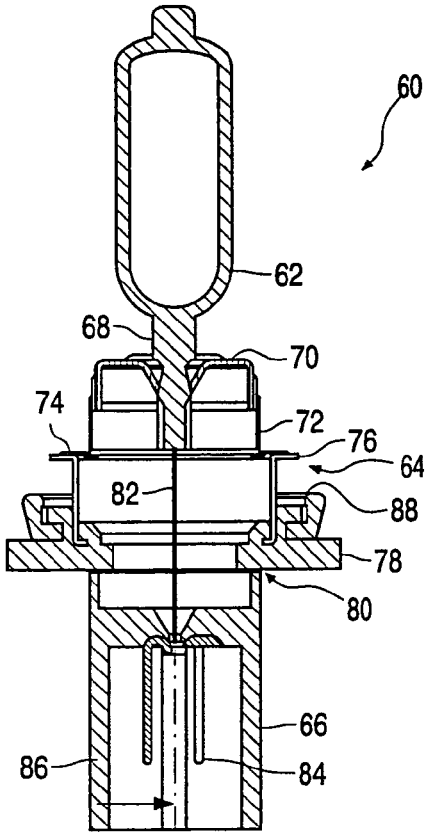
FIG. 6 is a longitudinal sectional view through a fourth embodiment of a lamp in accordance with the invention.
Figure 7:
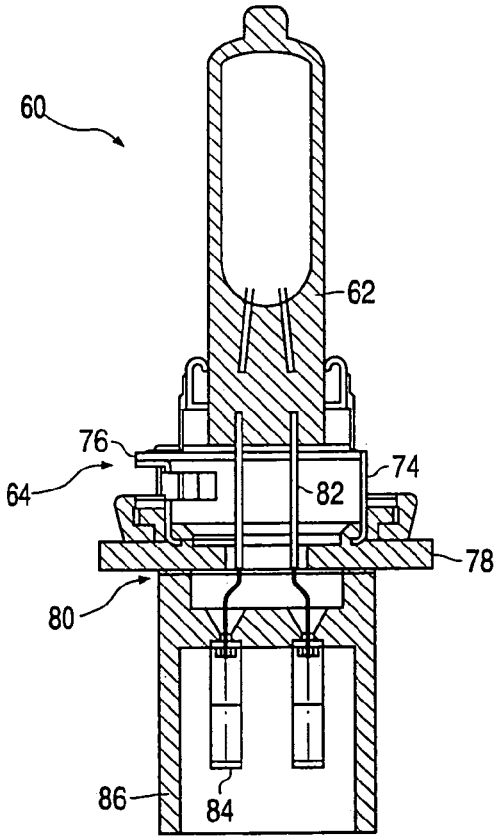
FIG. 7 is a longitudinal sectional view in a cutting plane of the lamp of FIG. 6 extending orthogonally to the longitudinal sectional view of FIG. 6.

FIGS. 6 and 7 are longitudinal sectional views of a lamp 60 in accordance with a fourth embodiment, the cutting planes shown in FIGS. 6 and 7 being orthogonally disposed with respect to each other. The lamp 60 comprises a burner 62 (which, in this example, is comprised of a glass bulb with a spiral-wound filament), an upper base part 64 and a lower base part 66. The burner 62 ends in a shaft 68 which is a tight fit in an inner metal sleeve 70. Said inner metal sleeve 70 is telescopically accommodated in an outer metal sleeve 72. Viewed in the longitudinal direction, the outer metal sleeve 72 precedes a sleeve 74, which is connected to the outer metal sleeve and forms a flange 76. The sleeve 74 is cast into a basis 78 of plastics. The upper part 64 of the base is welded to the lower part 66 at the location 80, said lower part also being made of plastics. The place of contact 80 corresponds to an approximately ring-shaped plane.

Contact leads 82 projecting from the burner 62 extend into the lower base part 66 where they are connected to the plug contacts 84 arranged there. These plug contacts 84 are surrounded by a plug housing 86.

The upper part 64 of the base forms a ring-shaped reference face 88. This reference face 88 serves to accurately position the lamp 60 in a reflector. In the assembled state of a headlamp, the reference face 88 bears on corresponding reference faces of the seating.

Figure 8:
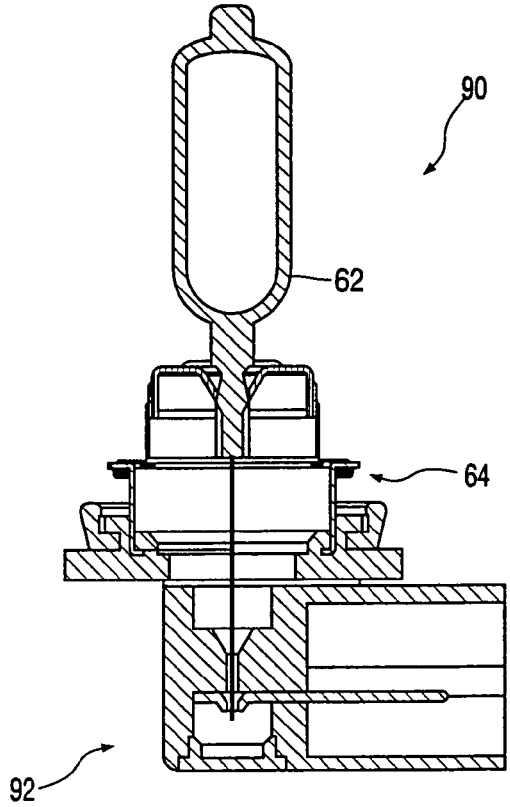
FIG. 8 is a longitudinal sectional view through a fifth embodiment of a lamp in accordance with the invention.
Figure 9:
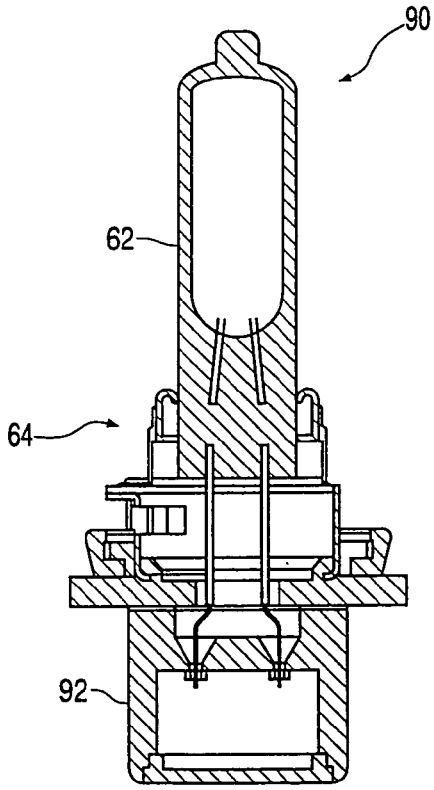
FIG. 9 is a longitudinal sectional view in a cutting plane through the lamp of FIG. 8 extending orthogonally to the longitudinal sectional view of FIG. 8.

FIGS. 8 and 9 show two different longitudinal sectional views of a fifth embodiment of a lamp 90 comprising a burner 62 and an upper base part 64, which are identical to the corresponding parts of the lamp 60 shown in FIG. 6. Therefore these parts are not described in detail again.

The lamp 90, however, comprises a lower base part 92 the shape of which differs from that of the lower base part 66 of the lamp 60 shown in FIG. 6. The lower base part 66 comprises a plug connection device that extends parallel to the longitudinal axis of the lamp 60 ("straight" plug), whereas the lower base part 92 of the lamp 90 shown in FIG. 8 comprises a plug connection device that extends perpendicularly to the longitudinal axis of the lamp 90 ("bent" plug).

Figure 10:
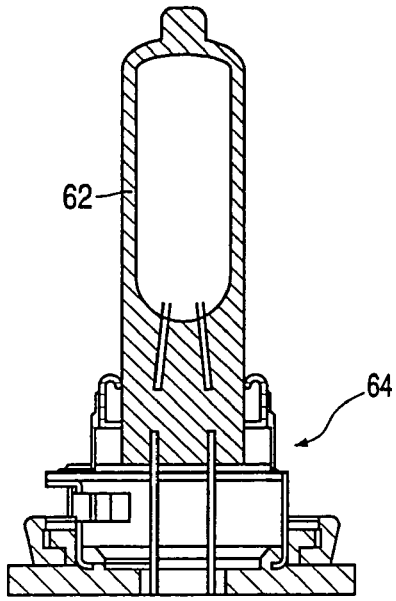
FIG. 10 is a longitudinal sectional view through a unit comprised of an upper base part and a burner of the lamps shown in FIGS. 6 and 8.
Figure 11:
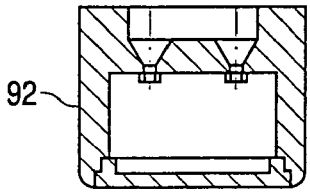
FIG. 11 is a longitudinal sectional view through the lower base part of the lamp shown in FIG. 8.
Figure 12:
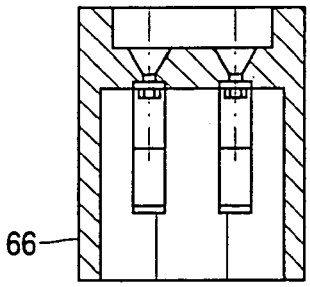
FIG. 12 is a longitudinal sectional view through the lower base part of the lamp shown in FIG. 6.

In FIGS. 10–12, the upper base part 64 accommodating the burner 62, and the two lower base parts 92, 66 are shown separately once again.

The lamps 60, 90 are two examples of lamps of a series of lamps comprising an identical burner, an identical upper base part and different lower base parts. The electrical properties of the lamp are determined by the burner. Therefore, as regards the electrical properties, all lamps of the series are identical. Also as regards the reference faces 88 for positioning the lamps 60, 90 in a reflector, the lamps are identical. These lamps differ only in the way in which electrical contact is made. The examples shown comprise connection devices for straight and bent plugs. Dependent upon the requirements to be met for a specific application, further plug embodiments and connection types may be provided.

In the manufacture of the lamps 60, 90, the burners 62 and the upper parts 64 of the base are manufactured in large quantities. The burners 62 are introduced into the upper parts 64 of the base, and the sleeve 70 which is a press fit on the shaft 68 of the burner 62 is accommodated in the outer sleeve 72. Subsequently, the burner 62 is accurately aligned relative to the reference faces 88. The burner 62 is aligned such that one or more spiral-wound filaments accommodated therein (not shown) are in an exactly defined position with respect to the reference face 88. In this position of the burner, the inner sleeve 70 is rigidly connected to the outer sleeve 72, for example so as to be a tight fit therein or by laser welding. In the manufacture of a series of lamps, the units comprised of the burner 62 and the upper base element are subsequently manufactured so as to be completely aligned. Dependent upon the contact requirements, i.e. whether, for example, straight or bent plug connections are desired, said completely aligned units are united with appropriate lower base parts for connecting straight plugs 66 or bent plugs 92 by means of welding (by means of one of the above-mentioned plastic welding processes) or by means of bonding using an adhesive. In this process, also the electrical contacts are provided, i.e. the contacts 82 are connected to the plug contacts 84.

The invention can be summarized as follows: a lamp, a series of lamps as well as a method of manufacturing lamps, in particular lamps for automotive headlights, are described. Said lamps comprise a burner for generating light, which burner is held in position in an upper base part. Said upper base part also comprises reference elements, for example a securing ring, for positioning the lamp at a headlight. In addition, a lower base part comprising a connection device for electrical contacts is provided. The lower base part and the upper base part are at least partly made of plastics and are connected together by means of welding or bonding using an adhesive.

In a series of lamps, all lamps of said series comprise identical burners and identical upper base parts, while different types of lower base parts are available. In the manufacturing process, the burners are first introduced into the upper base parts and, preferably, after having been oriented with respect to the reference element, fixed in position. Next, lower base parts including the electrical connection device of the desired shape are connected with the upper base parts.

Further modifications relate to a two-piece embodiment of the lower base part, enabling electrical contact elements to be readily accommodated, and to the manufacture of the upper base part and the lower base part from different plastics resins.

The invention claimed is:

1. A lamp comprising:

a burner for generating light, which burner is held in position in a first base part, which first base part comprises means for holding the burner in position and at least one reference element for positioning the lamp in an automotive headlight, and comprising a second base part which is connected to the first base part, which second base part comprises an electrical connection device, and the first base part and the second base part are at least partly made of plastics and are connected together by means of at least one of welding and bonding using an adhesive, wherein the first base part and the second base part are made of different plastic materials.

2. The lamp as claimed in claim 1, wherein the first base part and the second base part are welded together by means of plastics welding process without welding aids being provided between the base parts by means of at least one of heat-tool welding, ultrasound welding and friction welding.

3. The lamp as claimed in claim 1, wherein the means for holding the burner in position hold said burner in an orientable manner, said burner being fixed in an oriented position.

4. The lamp as claimed in claim 1, wherein the second base part is composed of a center portion and an end portion, which are connected together by means of a least one of welding and bonding using an adhesive, and the electrical connection device comprises at least one electrical contact element which is fixed between the center portion and the end portion.

5. The lamp as claimed in claim 1, wherein a first plastic material of the first base part has at least one of a higher temperature stability and a resistance to UV radiation then a second plastic material of the second base part.

6. A method of manufacturing lamps, comprising the acts of:

introducing a burner into a first base part comprising at least one reference element for positioning the lamp at an automotive headlight, connecting the burner to holding means provided at the first base part, connecting the first base part to a second base part comprising an electrical connection device by means of at least one of welding and bonding using an adhesive, wherein the first base part and the second base part are made of different plastic materials.

7. The method as claimed in claim 6, after said introducing act, further comprising the acts of:

orienting the burner relative to the reference element to form a completed first unit, and connecting the completed first unit to the second base part.

8. The method as claimed in claim 6, wherein a first plastic material of the first base part has at least one of a higher temperature stability and a resistance to UV radiation then a second plastic material of the second base part.

9. A lamp comprising:

a burner configured to generate light; and a base having a first part connectable to a second part; the first part being configured to hold said burner in a fixed position, and the second part being configured to allow electrical connection to the burner;

wherein the first base part and the second base part are made of different plastic materials.

10. The lamp of claim 9, wherein a first plastic material of the first base part has at least one of a higher temperature stability and a resistance to UV radiation then a second plastic material of the second base part.

11. The lamp of claim 9, wherein the first base part and the second base part are connected together by at least one of welding and bonding using an adhesive.

* * * * *

UNITED STATES PATENT AND TRADEMARK OFFICE

CERTIFICATE OF CORRECTION

PATENT NO. : 7,119,483 B2
APPLICATION NO. : 10/482143
DATED : October 10, 2006
INVENTOR(S) : Westemeyer et al.

It is certified that error appears in the above-identified patent and that said Letters Patent is hereby corrected as shown below:

Title Page # 75
Please correct the first inventor's name to read: --Manfred Westemeyer--.

Signed and Sealed this

Twenty-seventh Day of March, 2007

JON W. DUDAS
*Director of the United States Patent and Trademark Office*